US010088267B2

(12) United States Patent
Slater

(10) Patent No.: US 10,088,267 B2
(45) Date of Patent: Oct. 2, 2018

(54) ADJUSTABLE CHEEK REST

(71) Applicant: Rick Bradford Slater, Hillsboro, OR (US)

(72) Inventor: Rick Bradford Slater, Hillsboro, OR (US)

( * ) Notice: Subject to any disclaimer, the term of this patent is extended or adjusted under 35 U.S.C. 154(b) by 608 days.

(21) Appl. No.: 14/220,907

(22) Filed: Mar. 20, 2014

(65) Prior Publication Data

US 2014/0283428 A1 Sep. 25, 2014

Related U.S. Application Data

(60) Provisional application No. 61/803,559, filed on Mar. 20, 2013.

(51) Int. Cl.
*F41C 23/14* (2006.01)

(52) U.S. Cl.
CPC ..... *F41C 23/14* (2013.01)

(58) Field of Classification Search
CPC ..... F41C 23/00; F41C 23/04; F41C 23/14; F41C 23/18
USPC ..... 42/73, 74, 71.01, 90
See application file for complete search history.

(56) References Cited

U.S. PATENT DOCUMENTS 616,424 A * 12/1898 Rowley ..... 42/71.01
1,032,628 A * 7/1912 Sherman ..... 42/74
1,973,811 A * 9/1934 Jessup ..... 42/74
2,100,514 A * 11/1937 Miller et al. ..... 42/71.01
2,188,691 A * 1/1940 Rigandi ..... 42/74
2,282,428 A * 5/1942 Rigandi ..... 42/74
2,451,473 A * 10/1948 Cooper ..... 42/74
2,677,207 A * 5/1954 Stewart ..... 42/74
3,324,587 A * 6/1967 Bryan ..... 42/70.06
3,710,496 A * 1/1973 Packmayr et al. ..... 42/71.01
4,120,108 A * 10/1978 Vickers et al. ..... 42/74
4,122,623 A * 10/1978 Stice ..... 42/73
4,663,877 A * 5/1987 Bragg ..... 42/74
D300,343 S * 3/1989 Gannon ..... D22/108
4,896,446 A * 1/1990 Gregory ..... 42/73
5,031,348 A * 7/1991 Carey ..... 42/74
5,075,995 A * 12/1991 Kennel ..... 42/73
5,235,764 A * 8/1993 Perazzi ..... 42/73
5,265,365 A * 11/1993 Finn ..... 42/74
5,392,553 A * 2/1995 Carey ..... 42/73
5,771,622 A * 6/1998 Koziuk et al. ..... 42/74
5,970,642 A * 10/1999 Martin ..... 42/73
6,481,142 B1 * 11/2002 McCarthy ..... 42/74
7,418,797 B1 * 9/2008 Crose ..... 42/74
7,930,849 B2 * 4/2011 Abraham et al. ..... 42/73
(Continued)

*Primary Examiner* — Jonathan C Weber

(57) ABSTRACT

An adjustable cheek rest for a rifle is formed with a top member, a lower member, a cushion pad and a plurality of accessories. This cheek rest is adjustably and removably affixed to a stock of the rifle. Both the top member and the lower member are in symmetrical shape and are made of moldable plastic materials including the thermoplastic acrylic-polyvinyl chloride material. The top member and the lower member are foldable to fit the longitudinal cross sectional profile of the stick of rifle. There are top fastener holes located on the top member and their corresponding lower fastener holes located on the low member, which are adjustably fastened by fastener. Straps go through strap cuts in the lower member, so as to removably affix the cheek rest to the stock of the rifle.

4 Claims, 8 Drawing Sheets

(56) References Cited

U.S. PATENT DOCUMENTS

| | | | | |
|---|---|---|---|---|
| 8,051,596 | B1 * | 11/2011 | Thomas, Jr. | 42/94 |
| 8,341,867 | B2 * | 1/2013 | Criswell | 42/73 |
| 8,984,790 | B2 * | 3/2015 | Wilson et al. | 42/73 |
| 2002/0053156 | A1 * | 5/2002 | McCarthy | 42/74 |
| 2007/0101631 | A1 * | 5/2007 | Bentley | 42/74 |
| 2008/0028662 | A1 * | 2/2008 | Abraham et al. | 42/73 |
| 2009/0288324 | A1 * | 11/2009 | Peterson et al. | 42/75.03 |
| 2011/0016764 | A1 * | 1/2011 | Cales | 42/90 |
| 2012/0110884 | A1 * | 5/2012 | Criswell | 42/73 |
| 2014/0196343 | A1 * | 7/2014 | Wilson et al. | 42/71.01 |
| 2014/0245649 | A1 * | 9/2014 | Fluhr et al. | 42/73 |

* cited by examiner

ADJUSTABLE CHEEK REST

The current application claims a priority to the U.S. Provisional Patent Application Ser. No. 61/803,559, filed on Mar. 20, 2013.

FIELD OF THE INVENTION

The present invention generally relates to an apparatus for a firearm stock rest. More specifically, the apparatus is a rifle cheek rest which attaches to a rifle stock and allows a user to rest his/her cheek at the correct height for visual alignment with a sighting device.

BACKGROUND OF THE INVENTION

Modern rifle is often used with a sighting device in order to improve the targeting. When using a rifle with a sighting device such as a telescopic scope, an eye of a user often needs to be brought up to the level of the sighting device, which is inconvenient in many situations.

In order to solve the aforementioned problem, various devices have been designed to provide a convenient support for a rifle user. Current products on the market could provide an apparatus onto which a user can rest his/her cheek while using a sighting device that is mounted to a rifle. Some of these products do provide an effective support for a rifle user's cheek. However, most of such products include certain major drawbacks.

One key drawback of the currently available cheek rests is that they need to permanently change or compromise some rifle components, such as the stock of a rifle. As for these available rifle cheek rest products, one of the most common approaches for mounting the cheek rest is to firstly drill holes in the stock of the rifle. Albeit pretty small, such holes still irrevocably change the structure and appearance of the rifle. On the other hand, in a situation when the user decides to uninstall the cheek rest from the rifle, the drilled holes are still in the stock of rifle, which will give the rifle an undesirable look.

In this regard, one principal objective of the present invention is to provide a rifle cheek rest apparatus, which not only offers an effective functionality as a cheek rest to facilitate a user to use the sighting device, but also a convenient, light weight, comfortable, and most importantly, capable of being mounted onto and dismounted from the stock of a rifle easily and with no any permanent change or modification remaining on the rifle. The present invention is a removable solution which does not make any permanent changes to the stock of the rifle. As mentioned above, the apparatus provided in the present invention is easy to install, easy to remove, and requires no permanent alterations to the rifle stock. In this way, the apparatus disclosed in the present invention is able to work with the sighting device which is installed on the breech of the rifle without permanently altering the rifle stock. On the other hand, the cheek rest of the present invention is easily adjustable. Accordingly, it can be conveniently used for a wide variety of different individuals.

DETAIL DESCRIPTIONS OF THE INVENTION

Figure 1:
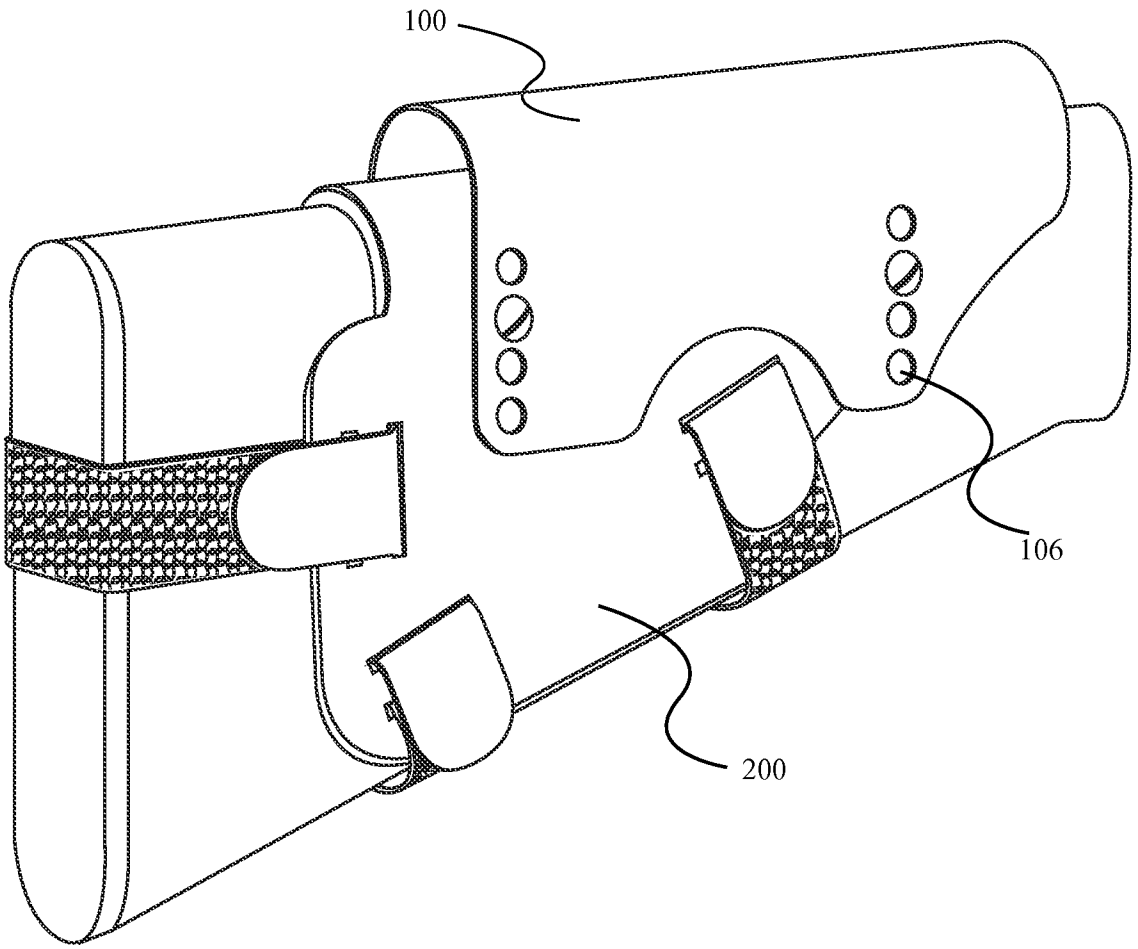
FIG. 1 is an illustration of the present invention when it is assembled on a rifle stock.
Figure 2:
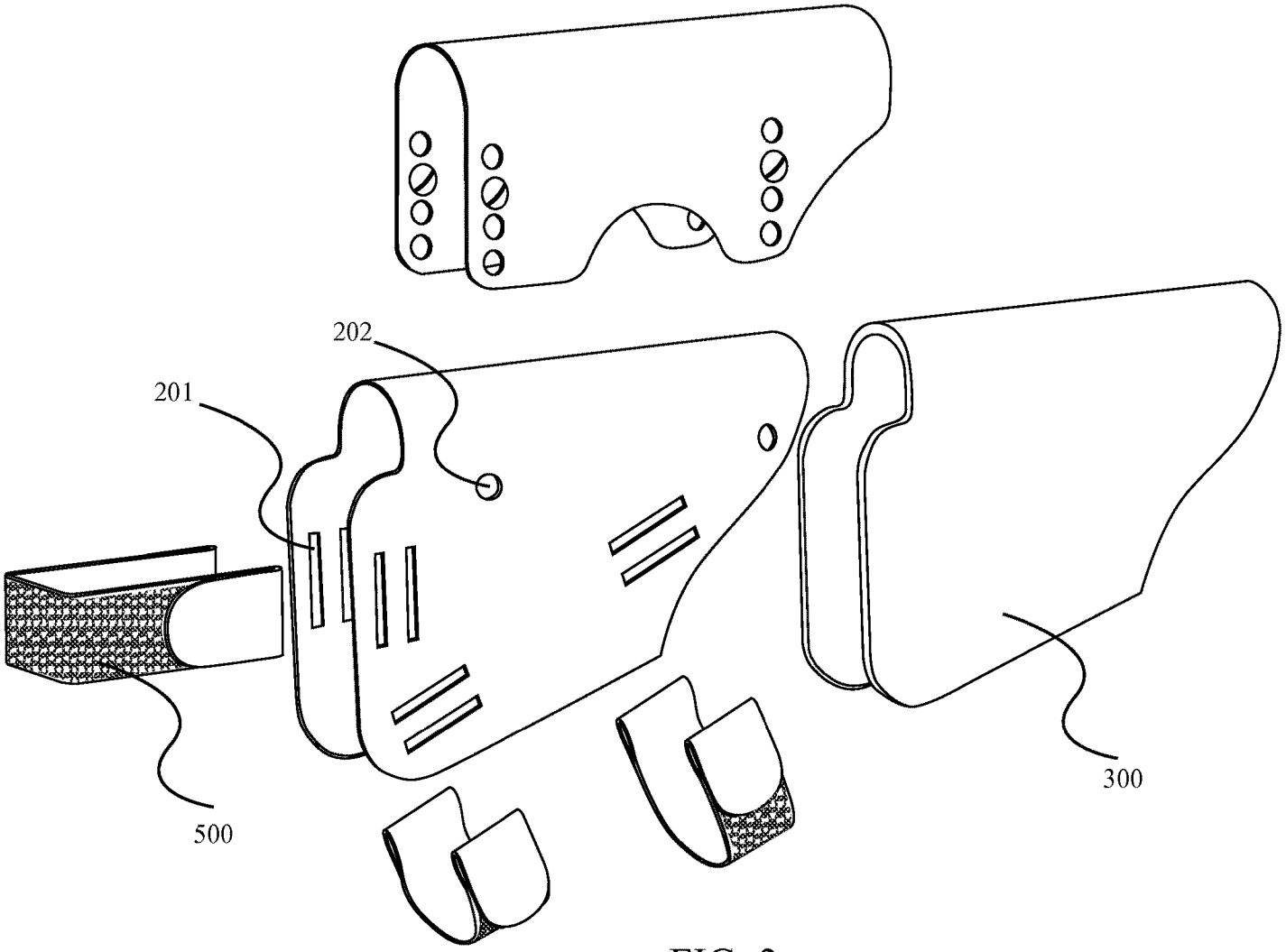
FIG. 2 is an exploded view of the present invention.
Figure 3:
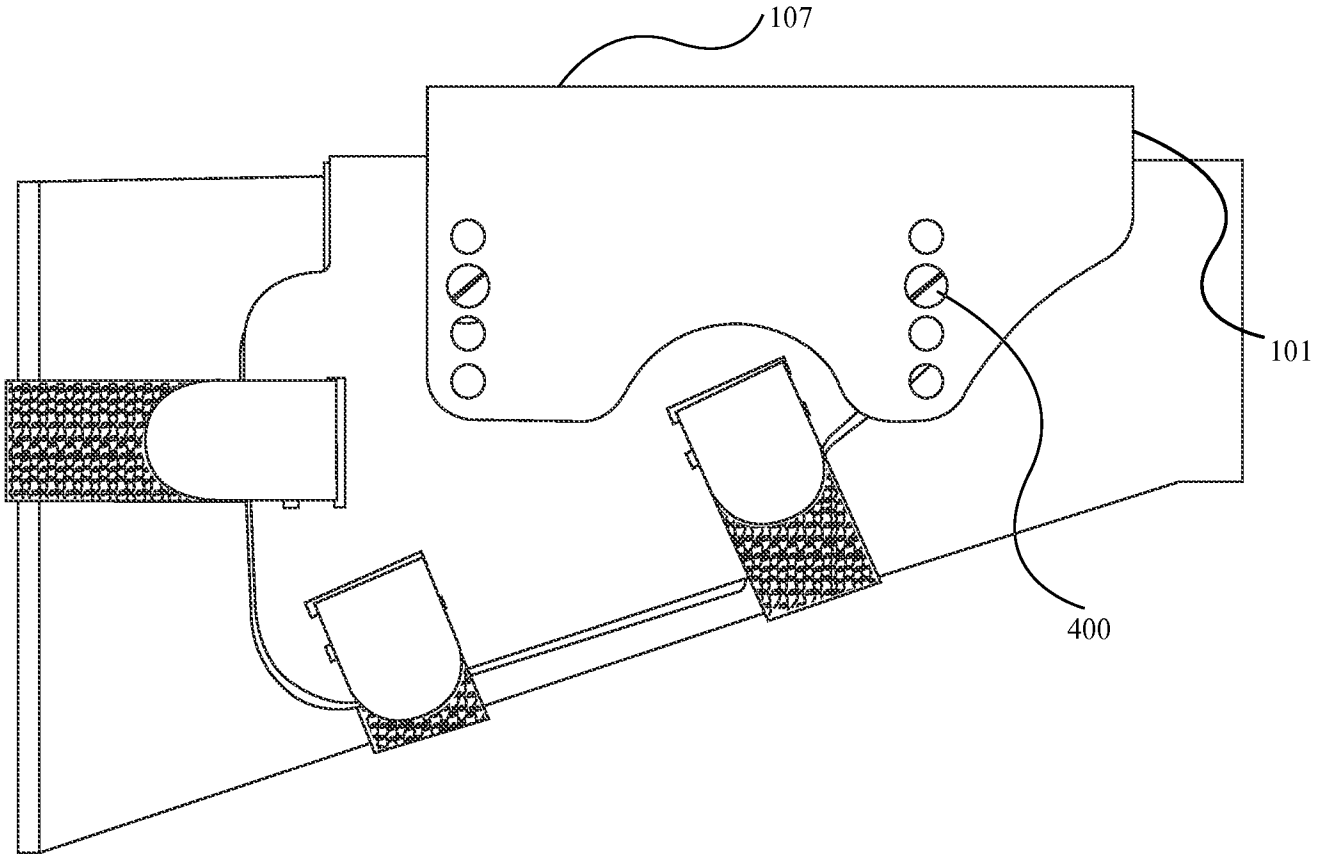
FIG. 3 is a right view of the present invention.
Figure 4:
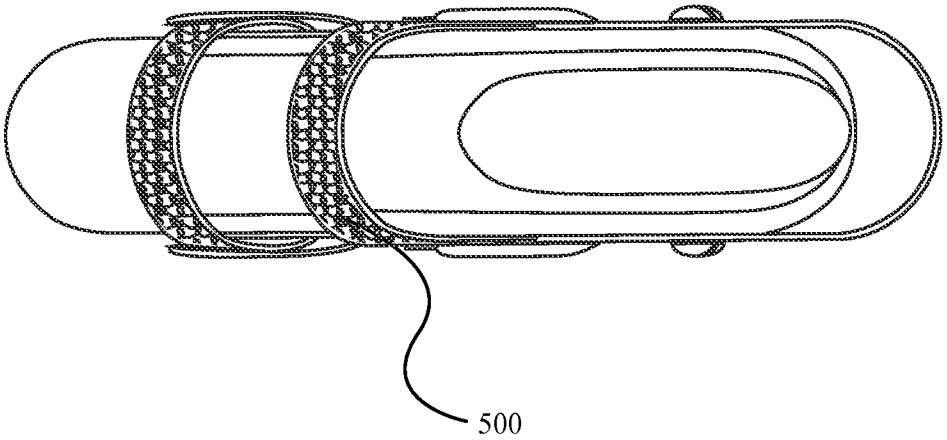
FIG. 4 is a bottom view of the present invention.
Figure 5:
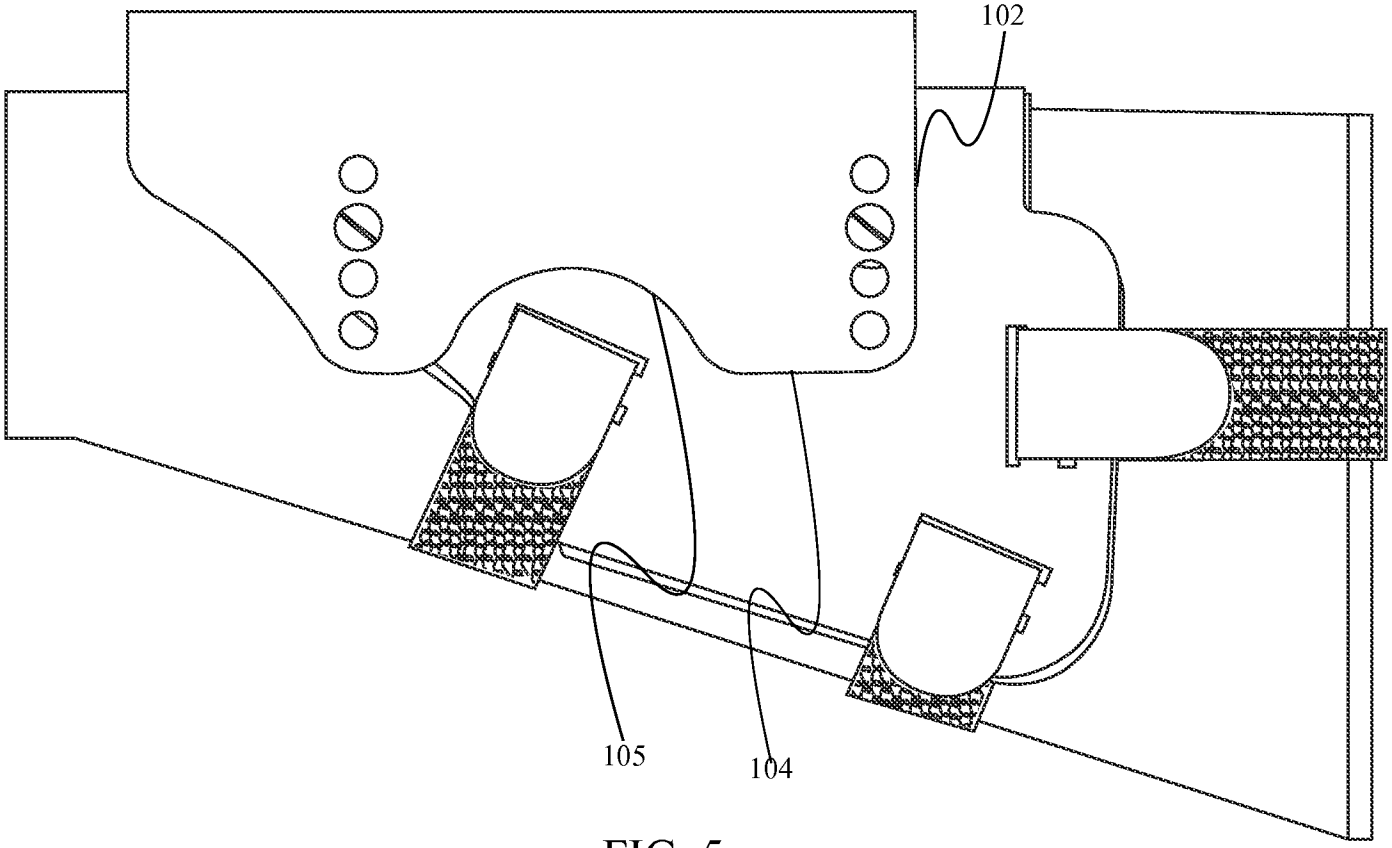
FIG. 5 is a left view of the present invention.
Figure 6:
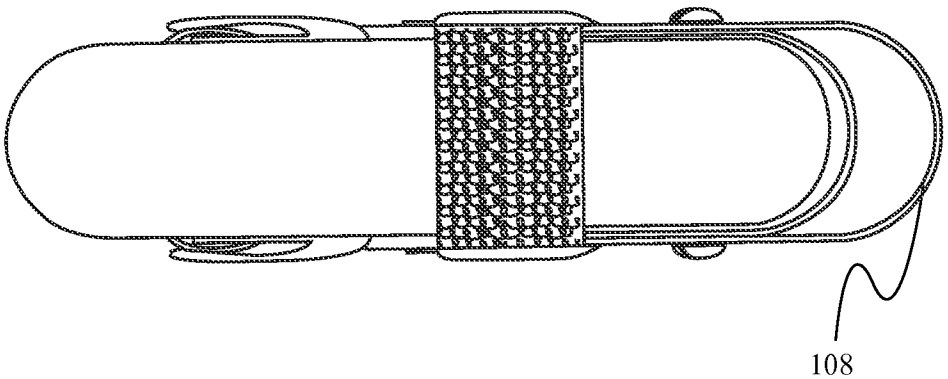
FIG. 6 is a back view of the present invention.
Figure 7:
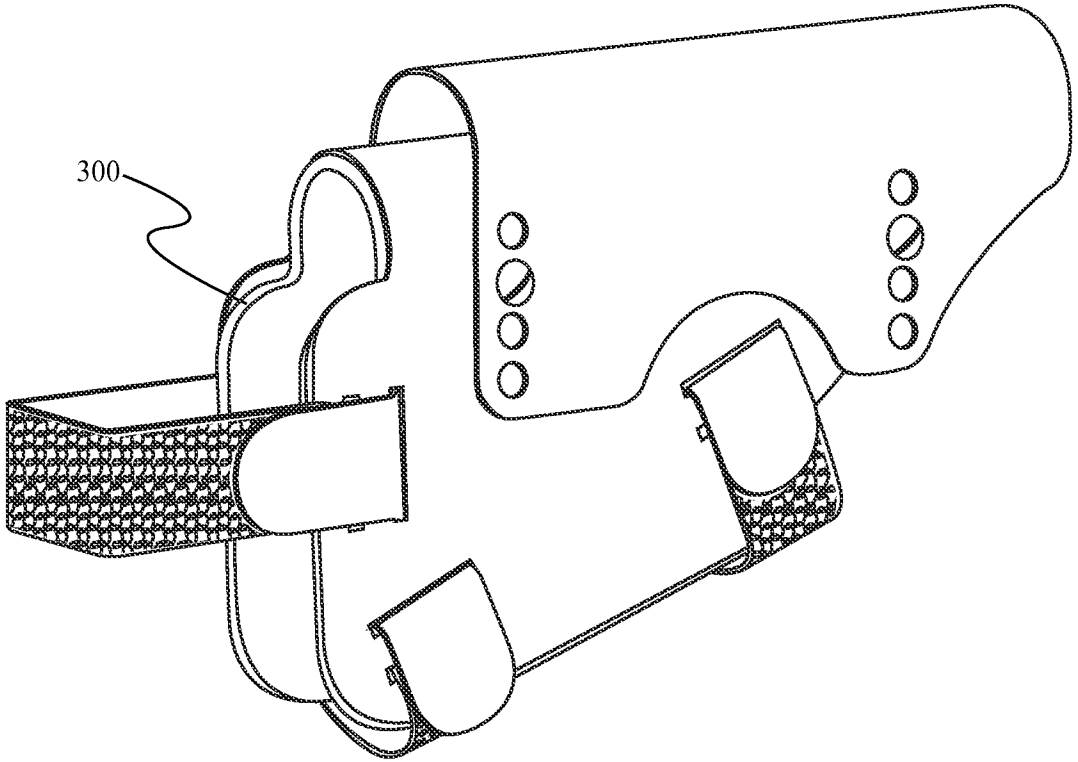
FIG. 7 is an illustration shown the cushion pad below the lower member of the present invention.
Figure 8:
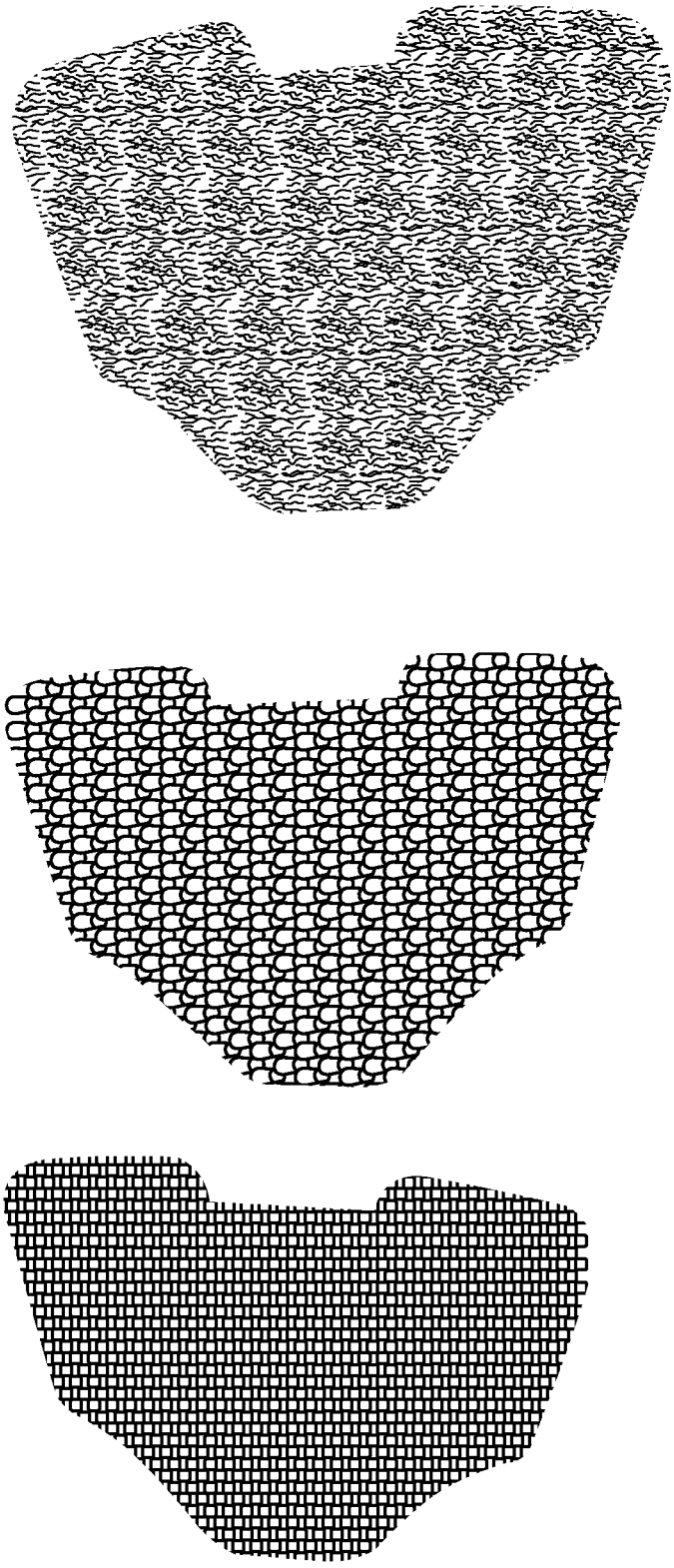
FIG. 8 is an illustration of different patterns of the cushion pad.

All illustrations of the drawings are for the purpose of describing selected versions of the present invention and are not intended to limit the scope of the present invention.

The present invention is a rifle cheek rest that helps to support a user's cheek when the user is using a sighting device mounted on the rifle. In comparison to other currently available products for the same purpose, the cheek rest of the present invention has two major advantages. First, it is removably mounted on a stock of the rifle. In this way, it will not change, modify or damage the rifle's structure. In this regard, when a user has decided to dismount it from the rifle stock, it can be easily removed from the rifle with none of its elements remaining on the rifle and with no change or modification left on the rifle's structure or appearance. Second, it is adjustable. Since its main function is to provide a support or rest for a user's cheek, in particular when the user is using a sighting device mounted on the rifle, different people have varying requirements in regards to the height and/or position of the cheek rest. Accordingly, a rifle cheek rest with adjustable height and location is able to meet the requirements of different individuals.

In order to achieve the aforementioned functionalities and product advantages, the cheek rest of the present invention comprising the component set forth below.

It contains a top member. The top member is made of a moldable plastic material. A typical a moldable plastic material could be KYDEX® or HOLSTEX®. Kydex is a line of thermoplastic acrylic-polyvinyl chloride materials manufactured by Kydex LLC. It has a wide variety of applications, including for firearm holsters. The Holstex is a similar moldable plastic material with a strong scratch resistance and heat-resistant surface protection mask. In addition to the above mentioned plastic materials, any other material that is suitable for the particular function of the present invention could be used here to make the top member.

The top member 100 has four sides, namely the first side 101, the second side 102, the third side 103 and the fourth side 104. Among them, the first side is opposing the second side; the third side is opposing the fourth side. The first side is modified to fit the shape of the stock. The second side has been uniquely modified to fit each different user's cheek so as to provide a comfortable rest for the user. The top member is symmetrical along the line connecting the midpoint of its first side and the midpoint of its second side. The top member is foldable along the line 107 connecting the midpoint of the first side and the midpoint of the second side, so as to form a U shaped cross section 108 that matches the longitudinal cross sectional profile of a rifle stock. In addition, there is an arcuate cut 105 at the third side and the fourth side, respectively. Such arcuate cut functions to facilitate the assembly of some accessories of the present invention, such as a strap.

In addition, the top member comprises a plurality of top fastener holes 106. The top fastener holes are arranged in such a way that by selecting different fastener holes, the distance between the line connecting the midpoint of the first side and the midpoint of the second side would be different from the rifle stock. That is to say, the height of the top member from the rifle stock would be different. Via the foregoing approach, the height of the top member where a user's cheek will rest is adjustable. The cheek rest of the present invention is adjustable, which makes it suitable for the rifle users with different physical profiles and unique cheek rest setting preferences.

In the product, the rifle cheek rest is available in different colors and different textures and finishing; for examples, various colors such as yellow, brown, green, olive drab, red, black and the like; and various textures such as black carbon fiber pattern, striped pattern, leather like pattern, fabric like pattern and so on.

The thickness of the top member material ranges between 0.060 and 0.125 inches. Moreover, any other thickness that is suitable for the purpose of the present invention can also be applied in the present invention.

Furthermore, a specific design, such as a user's initial, a particular symbol, pattern or design can be printed or carved onto the top member, which not only works as a personalized design, but also functions as an easily distinguishable symbol that helps a user to identify his or her rifle quickly.

Underneath the top member, there is the lower member 200. Similar to the above top member, the lower member could also be made of a moldable plastic material. A typical a moldable plastic material could be KYDEX® or HOLSTEX®. In addition to the above mentioned plastic materials, any other material that is suitable for the particular function of the present invention could be used here to make the lower member.

The lower member 200 is also in a symmetrical form. The lower member is foldable along its bilateral symmetrical axis, so as to form a U shaped cross section 203 that matches the longitudinal cross sectional profile of a rifle stock. In addition, the lower member comprises a plurality of strap cuts 201. A strap can go through such a strap cut.

Moreover, the lower member comprises a plurality of lower fastener holes 202. The positioning of the lower fastener holes correspond to the positioning of the top fastener holes. Accordingly, they can be allied and coupled together via fasteners. That is to say, the top member is coupled and supported by the lower member of the present invention. The corresponding holes on the lower member facilitate adjustment of the height of the top member. Therefore, the cheek rest of the present invention is adjustable, which makes it suitable for the rifle users with different physical profiles and unique cheek rest setting preferences.

Similar to the top member, the lower member of the product is available in different colors and different textures and finishing; for examples, various colors such as yellow, brown, green, olive drab, red, black and the like; and various textures such as black carbon fiber pattern, striped pattern, leather like pattern, fabric like pattern and so on.

The thickness of the lower member also material ranges between 0.060 and 0.125 inches. Moreover, any other thickness that makes be suitable for the purpose of the present invention can also be applied in the present invention.

The two pieces, the top member and the lower member of the present invention are cut or molded and then heated to a temperature ranging from 290 to 350 degrees for 50 to 90 seconds in an oven. Next, they are formed by placing them on a mold to form the desired shape.

The third piece, the cushion pad 300, is located below the lower member. The same of the cushion pad is similar to that of the lower member. Therefore, it can be entirely covered by the lower member.

The cushion pad mainly has the cushion function to absorb the recoil and shaking generated from a rifle discharge. It is either made of non-slip material or has an anti-slip structure, so as to prevent the cheek rest from slipping or moving while mounted on the stock. In this regard, any material is appropriate for such a function can be used to make the cushion pad of the present invention. In addition, any shape or pattern, such as solid or meshed structure can be used to make the cushion pad of the present invention.

Furthermore, the present invention also comprises a few accessories, which main include fasteners 400 and straps 500. The fasteners couple the top member and the lower member together via the corresponding top fastener holes and lower fastener holes. In addition, the coupling by fasteners is adjustable, so as to adjust the height of the top member.

Once the two pieces have been formed and cooled, they are riveted or screwed together by an eyelet rivet or Chicago screw or any type of similar fastener. The eyelet rivet and Chicago screw size range from ⅛" inch to ½" in size depending on if the top piece is to be made adjustable. There are many heights to the cheek rest depending on the top piece and how it is cut. The fixed top piece can range from being cut to provide a fixed ¼" inch of rise, and go to be as high as 2½" inch. The adjustable top piece is cut to range from ¼" to adjust to 2" and can be assembled to make height from and to that measurement.

The straps functions to affix the lower member of the present invention to the stock of a rifle through the strap cuts located on the lower member. In between the lower member and the rifle stock, there is the cushion pad mentioned above. The cheek rest is secured by 1 to 4 straps or other quantity of straps. The straps are held together so as to affix the cheek rest of the present invention on to a rifle's stock. The straps are held together via certain fastening means, such as a hook and loop fastener, for example, Velcro®, or similar type of material used for fastening, including straps with buckles.

Although the invention has been explained in relation to its preferred embodiment, it is to be understood that many other possible modifications and variations can be made without departing from the spirit and scope of the invention as herein described.

What is claimed is:

1. An adjustable cheek rest for a rifle, comprising: a top member comprising a first side; a second side; a third side; a fourth side; side first side being opposing to said second side; and said third side being opposing to said fourth side; a lower member; a cushion pad; a plurality of accessories; said cheek rest being adjustably and removably affixed to a stock of said rifle; said top member being made of a moldable plastic material; said moldable plastic material comprising a thermoplastic acrylic-polyvinyl chloride material; said lower member being between said top member and said cushion pad; said lower member being made of a moldable plastic material; said moldable plastic material comprising a thermoplastic acrylic-polyvinyl chloride material; a plurality of strap cuts; a plurality of lower fastener holes; said lower fastener holes being corresponding to said top fastener holes; said plurality of accessories comprising a plurality of fasteners and a plurality of straps; said plurality of fasteners adjustably fastening top fastener holes and corresponding lower fastener holes, so as to couple said top member and said lower member; said plurality of straps going through corresponding strap cuts on said lower member; and said plurality of straps adjustably and removably affixing said lower member onto said stock of said rifle, said top member further comprising a plurality of top fastener holes; said plurality of top fastener holes being arranged in a first manner; and said first manner allowing a distance between said stock of said rifle and a line connecting a midpoint of said first side and a midpoint of said second side to be adjustable, when a selection of top fastener holes from said plurality of top fastener holes for a coupling of said top member and said lower member changes.

2. An adjustable cheek rest for a rifle, comprising a top member; a lower member; a cushion pad; a plurality of accessories; said cheek rest being adjustably and removably affixed to a stock of said rifle; said top member comprising a first side, a second side, a third side, and a fourth side; said first side being opposing to said second side; said third side being opposing to said fourth side; said top member being made of a moldable plastic material; said moldable plastic material comprising a thermoplastic acrylic-polyvinyl chloride material; said lower member being between said top member and said cushion pad; said lower member being made of a moldable plastic material; said moldable plastic material comprising a thermoplastic acrylic-polyvinyl chloride material; said lower member being in a symmetrical shape; said lower member being foldable along its bilateral symmetrical axis; said lower member forming a U shaped cross section that matches the longitudinal cross sectional profile of said stock of said rifle; said lower member comprising a plurality of strap cuts and a plurality of lower fastener holes; said lower fastener holes being corresponding to said top fastener holes; said cushion pad being between said lower member and said stock of said rifle; said cushion pad absorbing a recoil generated from a rifle firing; said cushion pad preventing said adjustable cheek rest from slipping or moving during mounting, said first side fitting a shape of said stock of said rifle; said second side fitting a human cheek; said top member being symmetrical along a line connecting a midpoint of said first side and a midpoint of said second side; said top member being foldable along the line connecting the midpoint of the first side and the midpoint of the second side; said top member forming a U shaped cross section that matches the longitudinal cross sectional profile of said stock of said rifle; said top member further comprising arcuate cuts; a first arcuate cut of said arcuate cuts being located in said third side; a second arcuate cut of said arcuate cuts being located in said fourth side; said arcuate cuts facilitating assemblies of said plurality of accessories; said top member further comprising a plurality of top fastener holes; said plurality of top fastener holes being arranged in a first manner; and said first manner allowing a distance between said stock of said rifle and a line connecting a midpoint of said first side and a midpoint of said second side to be adjustable, when a selection of top fastener holes from said plurality of top fastener holes for a coupling of said top member and said lower member changes.

3. An adjustable cheek rest for a rifle, comprising a top member;

a lower member;

a cushion pad;

a plurality of accessories;

said cheek rest being adjustably and removably affixed to a stock of said rifle;

said top member comprising a first side, a second side, a third side, and a fourth side;

said first side being opposing to said second side;

said third side being opposing to said fourth side;

said top member being made of a moldable plastic material;

said moldable plastic material comprising a thermoplastic acrylic-polyvinyl chloride material;

said first side fitting a shape of said stock of said rifle;

said second side fitting a human check;

said top member being symmetrical along a line connecting a midpoint of said first side and a midpoint of said second side;

said top member being foldable along the line connecting the midpoint of the first side and the midpoint of the second side;

said top member forming a U shaped cross section that matches the longitudinal cross sectional profile of said stock of said rifle;

said top member further comprising arcuate cuts;

a first arcuate cut of said arcuate cuts being located in said third side;

a second arcuate cut of said arcuate cuts being located in said fourth side;

said arcuate cuts facilitating assemblies of said plurality of accessories;

said top member further comprising a plurality of top fastener holes;

said plurality of top fastener holes being arranged in a first manner;

said first manner allowing a distance between said stock of said rifle and a line connecting a midpoint of said first side and a midpoint of said second side to be adjustable, when a selection of top fastener holes from said plurality of top fastener holes for a coupling of said top member and said lower member changes; and said lower member being between said top member and said cushion pad;

said lower member being made of a moldable plastic material;

said moldable plastic material comprising a thermoplastic acrylic-polyvinyl chloride material;

said lower member being in a symmetrical shape;

said lower member being foldable along its bilateral symmetrical axis;

said lower member forming a U shaped cross section that matches the longitudinal cross sectional profile of said stock of said rifle;

said lower member comprising a plurality of strap cuts and a plurality of lower fastener holes; and said lower fastener holes being corresponding to said top fastener holes.

4. The adjustable cheek rest for a rifle as set forth in claim 3, wherein said cushion pad being between said lower member and said stock of said rifle;

said cushion pad absorbing a recoil generated from a rifle firing;

said cushion pad preventing said adjustable cheek rest from slipping or moving during mounting;

said plurality of accessories comprising a plurality of fasteners and a plurality of straps;

said plurality of fasteners adjustably fastening top fastener holes and corresponding lower fastener holes, so as to couple said top member and said lower member;

said plurality of straps going through corresponding strap cuts on said lower member; and said plurality of straps adjustably and removably affixing said lower member onto said stock of said rifle.

* * * * *